United States Patent [19]

Dubois

[11] Patent Number: 4,540,291

[45] Date of Patent: Sep. 10, 1985

[54] HOROLOGY MODULE COMPRISING AN ELECTRONIC CIRCUIT AND A CALENDAR DEVICE

[75] Inventor: Jean-Daniel Dubois, L'Orient

[73] Assignee: Nouvelle Lemania S.A., Vaud, Switzerland

[21] Appl. No.: 527,518

[22] PCT Filed: Dec. 3, 1982

[86] PCT No.: PCT/CH82/00128

§ 371 Date: Aug. 16, 1983

§ 102(e) Date: Aug. 16, 1983

[87] PCT Pub. No.: WO83/02340

PCT Pub. Date: Jul. 7, 1983

[30] Foreign Application Priority Data

Dec. 28, 1981 [CH] Switzerland ..... 8313/81

[51] Int. Cl.[3] ..... G04B 19/24

[52] U.S. Cl. ..... 368/28; 368/34; 368/187

[58] Field of Search ..... 368/28–34, 368/185, 187, 190

[56] References Cited

U.S. PATENT DOCUMENTS

| | | | |
|---|---|---|---|
| 4,232,510 | 11/1980 | Tamaru et al. | 368/28 |
| 4,254,490 | 3/1981 | Ganter | 368/29 |
| 4,276,628 | 6/1981 | Nomura | 368/28 |
| 4,320,476 | 3/1982 | Berney | 368/28 |
| 4,376,991 | 3/1983 | Piaget | 368/28 |

FOREIGN PATENT DOCUMENTS

| | | |
|---|---|---|
| 2925278 | 1/1980 | Fed. Rep. of Germany . |
| 3100345 | 8/1982 | Fed. Rep. of Germany . |
| 2416503 | 8/1979 | France . |
| 2488703 | 2/1982 | France . |
| 2017356 | 10/1979 | United Kingdom . |

*Primary Examiner*—Vit W. Miska

*Attorney, Agent, or Firm*—Parkhurst & Oliff

[57] ABSTRACT

The liquid crystal display cell (21) indicates the date in an aperture situated at 12 o'clock. The hour wheel (31) and the center wheel (29) present coaxial pipes which pass through the dial and bear hour and minute hands. These wheels are driven by a wheel-train (30, 28, 27) actuated by the stepping motor (25) which receives its pulses from the circuit (23) controlled at a frequency of 1 Hz for example by the quartz (48). The 24-hour wheel (33) bears a contact element (46) which, once per revolution, grounds the terminal (47). The pulse which results therefrom is transmitted to a counter incorporated in the circuit (23). This counter controls the decoding circuit which controls the display cell (21). To effect the setting of the date, the stem (35) is brought into its intermediate position (II). The contact element (40) borne by the yoke (38) then grounds the terminal (41), which causes in the circuit (23) the emission of pulses at a frequency of 1 Hz which controls a repeated and rapid change of date.

5 Claims, 4 Drawing Figures

HOROLOGY MODULE COMPRISING AN ELECTRONIC CIRCUIT AND A CALENDAR DEVICE

Figure 1:
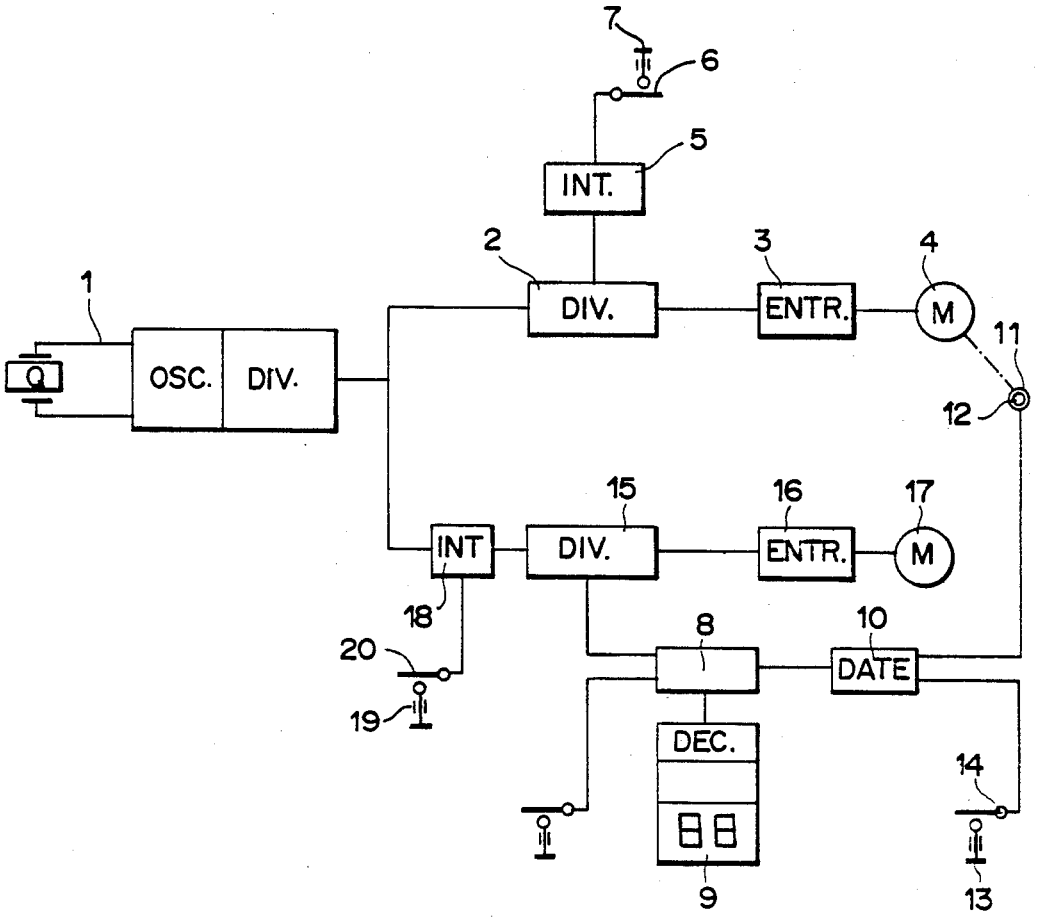

The present invention relates to horology modules comprising a display of the time by analogical means and in particular by means of hour and minute hands which are respectively borne by an hour wheel and a cannon-pinion, these two rotary parts being mounted coaxially at the center of the module.

At the present time, horology modules of this kind are in general driven by a stepping motor receiving its power from a battery, and the time standard is constituted by an electronic device such as a quartz oscillating circuit and a frequency divider. When it is desired to incorporate a means of displaying the date into a module of this kind, recourse is had in most cases to a display part of the type which has already been utilized in mechanical watches, i.e., a date ring disposed under the dial, and the indications of which appear in an aperture contrived in the dial. This date ring is driven by a jumping mechanism which winds itself little by little during the hours preceding midnight, so that the stepping motor which actuates the wheel-train encounters a greater resistance during these hours than during the greater part of the hours of the day. This circumstance exerts quite a considerable influence on the construction of the motor as well as on the general consumption of the power and the life of the batteries. To remedy this drawback it has already been proposed, especially in French patent application No. 24 88 703, to provide in the module for a second motor which receives pulses once per day and which causes the date ring to advance by one step around midnight. The control of this second motor results from a counting operation which must be effected in the electronic circuit controlled by the quartz time standard, so that it is necessary to see to it that the synchronization between the position of the hands and the position of the date ring is maintained.

In certain executions the mentioned difficulty is also remedied by providing for a display of the date by means of an electro-optical cell of which the inertia is nil, which is controlled directly by the electronic circuit without passing through a motor and which consequently avoids any momentary overload on the stepping motor driving the hour and minute hands. However, in this case also, it is necessary to see to it that the synchronisation between the counting effected by the electronic circuit and the position of the hands is maintained.

The present invention has as its object to furnish another solution to the problem evoked above, this other solution having the advantage of avoiding any risk of desynchronization between the display of the date and the display of the time.

To this end, the present invention has as its subject a horology module having an electronic circuit, a device for diplaying the time, namely, an hour wheel, and a calendar device having an electronically controlled display mechanism. The module further has a movable contact element rotationally driven by the hour wheel and capable, on each revolution, of establishing a connection with a terminal connected to the electronic control circuit. The electronic control circuit is arranged so as to be controlled by the establishment of this connection.

A first embodiment of the horology module according to the invention was conceived within the framework of a chronograph-watch, while other embodiments applied to modules of standard watches derive directly from the first embodiment.

Figure 2:
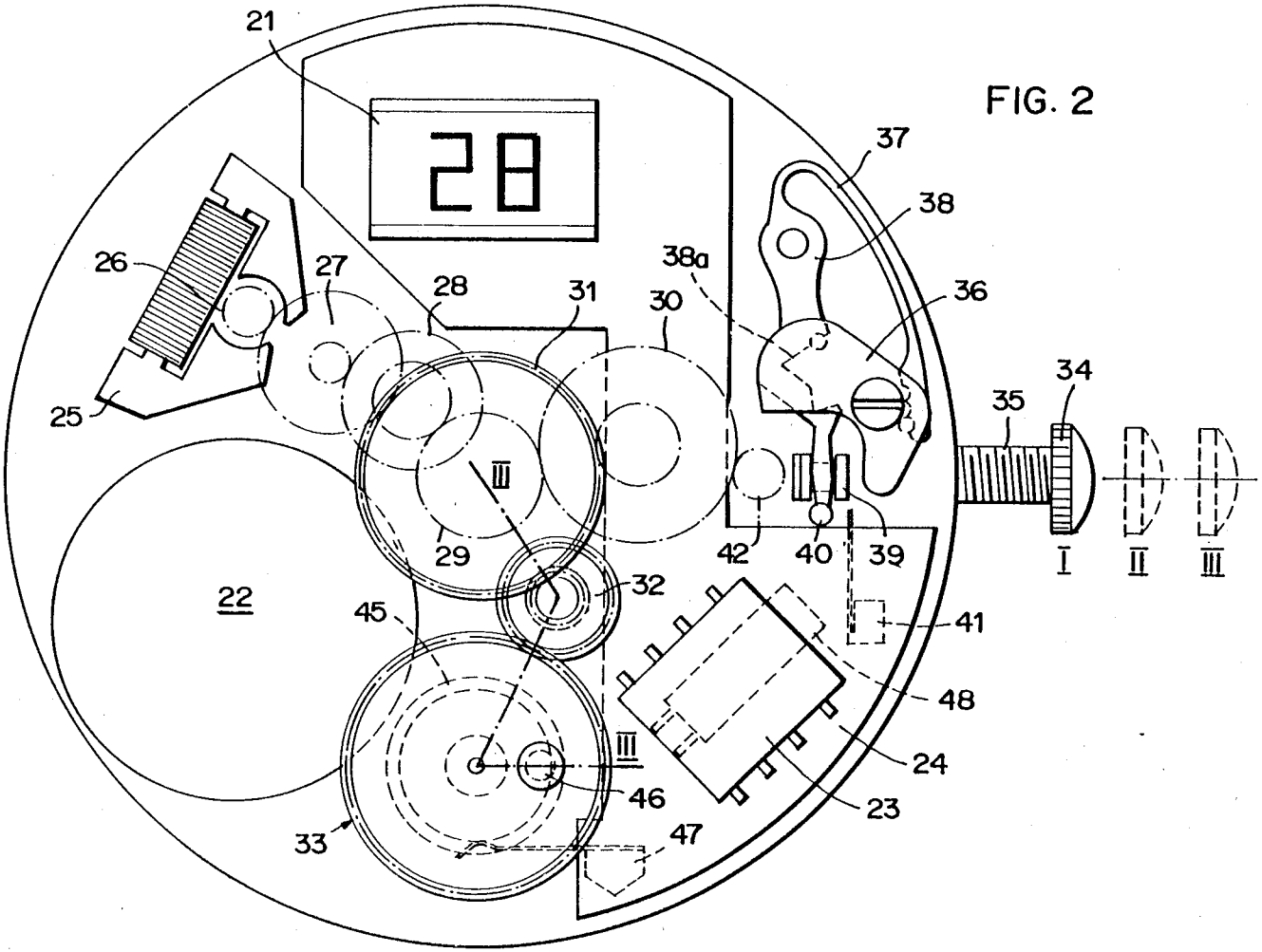
Figure 3:
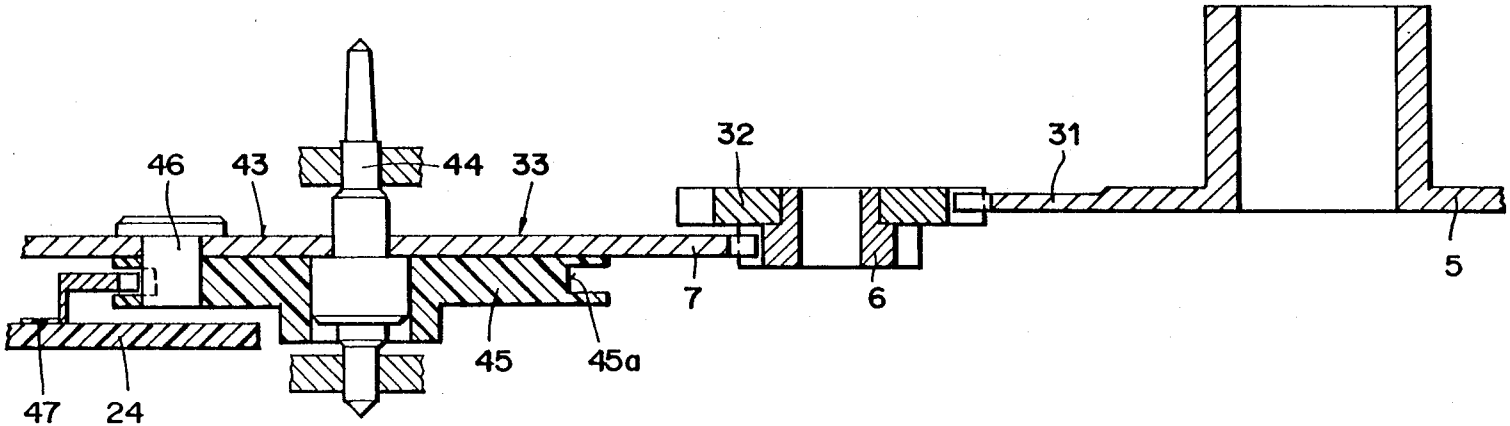

There are therefore going to be described below, by way of example, three embodiments of the subject of the invention, with reference to the appended drawings, of which FIG. 1 is a block diagram of the first embodiment, FIG. 2 a top plan view of a horology module which constitutes the second embodiment of the invention, FIG. 3 is a sectional view along the line III.III of FIG. 2, and FIG. 4 a view analogous to FIG. 2, showing the third embodiment of the subject of the invention.

It is not necessary to describe the first embodiment in all its details as many of them are background which is well known to one of ordinary skill in the art. Accordingly, only the elements which relate more specifically to the display of the time and of the date and are helpful for understanding what follows will be descibed.

FIG. 1 depicts the main circuits of an electronic chronograph watch module. The power source which feeds these circuits is a battery (not depicted). The time standard is constituted by an oscillator 1, a quartz Q, and an oscillating circuit OSC. Associated with this oscillator is a frequency divider DIV, the output of which supplies a signal at a frequency intermediate between that of the quartz Q and that which is necessary for controlling the display components of the watch. In a second stage of division designated by 2, the frequency is further reduced down to a value which is, for example, of 1 Hz, the ouput signal of the divider 2 serving to feed a driving circuit 3 which controls a stepping motor 4 of classic type. This stepping motor drives a conventional wheel-train which comprises, for example, a fourth wheel-and-pinion, an intermediate wheel-and-pinion, and a center wheel to which a cannon-pinion bearing a minute hand is coupled. The cannon-pinion may drive a minute wheel, the pinion of which itself engages an hour wheel, the pipe of which bears the hour hand. A switch circuit 5, which may be controlled by grounding a terminal 6 through to a contact element 7, permits engaging and disengaging the motor 4. This switch circuit 6 may be connected either to the frequency divider 2 or even directly to the driving circuit 3. The contact element 7 may be borne by a part of a control mechanism, for example a setting-lever actuated by a control stem disposed radially in the module, so that when this contact element 7 comes in contact with the terminal 6, the transmission of the pulses to the motor 4 is interrupted, and the latter stops.

The described module also comprises a date-display function, and that by means of a display cell 9, for example a liquid-crystal cell with two display positions. The electronic control circuit comprises a driving and decoding circuit DEC which controls the cell 9 and which can be fed by successive pulses, each pulse interacting with the decoding circuit in such a way that the figure displayed by the cell 9 increases by one unit and thus passes gradually from 1 to 31, then returning immediately from 31 to 1. This cell 9 can be placed immediately under an aperture of the dial or, as the case may be, countersunk within the dial. The date-display device further comprises a counter 10, the output of which processes pulses suitable for controlling the decoder of the cell 9. These pulses are transmitted to the decoder through a switch 8, thanks to which the display of the date can be put out of the circuit for independent operation, so that the cell 9 can serve to display other information, the processing of which presents no interest here.

For determining the frequency and the moment of appearance of the pulses which leave the counter 10, the module described comprises the following arrangement: the hour wheel (not depicted) which drives the motor 4 drives, by mechanical means which are not depicted in FIG. 1, a 24-hour wheel depicted schematically at 11 and which bears a contact element 12 describing a circular path at the rate of one revolution per 24 hours. This contact element cooperates with a fixed element so as to constitute a switch suitable for counting the days. As a matter of fact, once every 24 hours, this switch closes, and the counter 10 is then energized so as to send a pulse to the decoder 9.

Another contact element 13 forming part of the control mechanism, mounted, for example, on a yoke, permits, for a certain position of the control stem, grounding a fixed terminal 14 connected to the counter 10. When this terminal is grounded, the counter 10 emits a series of pulses permitting the calendar 9 to be brought up to date. These pulses may follow one another, for example, at a frequency of 1 Hz and start a few seconds after the contact element 13 has arrived in contact with the terminal 14.

The diagram of FIG. 1 relates to a module whose electronic system comprises still other elements, in particular a frequency divider 15, disposed parallel to the divider 2, and whose output controls a driving circuit 16 and a second motor 17. The pulses which drive the motor 17 are controlled by a switch 18 in turn controlled by a contact element 19 grounding a terminal 20. The device 15–20 constitutes a chronograph device with which the cell 9 is associated when it is engaged. In this case, signals at a frequency higher than that for controlling the motor 17, emitted by an intermediate ouput of the divider 15, are transmitted by the switch 8 to the decoder and to the display cell 9.

The practical embodiment of the various elements of the chronograph-watch, the electrical diagram of which is depicted in FIG. 1, will not be described in detail here. To the extent that it concerns the display of the date, and its correction, these elements can be identical to those which will be described hereafter referring to FIGS. 2, 3 and 4, which relate to two embodiments of the subject of the invention constituting calendar-watches.

FIG. 2 is a top plan view, partially schematic, depicting a calendar-watch in which the display of the date is carried out by means of an electro-optical cell 21. This watch comprises as power source a battery 22 which feeds an electronic circuit 23 fixed on a printed circuit board 24. The battery 22 further feeds a stepping motor 25, the rotor 26 of which drives a wheel-train made up of elements 27, 28, 29, the element 29 being a center wheel, the pipe of which can bear a central minute hand. This center wheel engages a minute wheel 30, the pinion of which drives an hour wheel 31. The pipe of this hour wheel can bear an ordinary hour hand, while its peripheral toothing drives an idler gear 32, the wheel toothing of which drives a 24-hour wheel 33.

The module of the watch depicted in FIG. 2 further comprises a control mechanism which can be operated by means of a crown 34 fixed to the end of a stem 35 disposed radially in the module. The axial position of this stem is determined by a setting-lever 36 of classic construction held in place by a spring 37 which is blanked in one piece with a yoke lever 38. This yoke 38 controls, on the one hand, a clutch-pinion 39 and, on the other hand, a switch which is constituted by a movable contact element 40 situated at the end of the finger of the yoke and by a terminal 41 made up of a metal blade, for example a blanked and bent gold blade. The base of this terminal 41 is soldered on the board 24 at the location of a conductive track connected to the circuit 23. The terminal 41 comprises, on the other hand, a tongue-shaped element which extends freely, and the end of which is facing the contact element 40. The yoke 38 comprises a notch **38*a* arranged so that when the stem 35 is pulled into an intermediate position (II), the contact element 40 and the clutch-pinion 39 are displaced toward the outside of the module, and the contact element 40 comes to touch the elastic tongue of the terminal 41**. This terminal is then grounded.

When the stem 35 is pulled into its outer position (III), the clutch-pinion 39 is brought in contact with a setting wheel 42 which engages the minute wheel 30. On the other hand, the switch 40/41 is again open. In this position, another switch (not depicted) is then closed, so that the transmission of the pulses to the motor 25 is blocked, and this motor is at a stop.

Preferably, the cell 21 will be a liquid crystal cell, although other electro-optical systems may likewise be used. This cell is mounted on a board 24, and its connection terminals (not depicted) are connected to the circuit 23 by conductive tracks.

The 24-hour wheel 33, which is driven at an angular speed equal to half that of the hour wheel, is depicted in more detail in FIG. 3. It is seen to comprise a metal disk 43 driven onto an arbor 44 sufficiently long to pass through the dial of the time-piece described and to bear at its upper end a 24-hour hand (not depicted). However, as a variant, this wheel might equally comprise a short arbor without indicator part. Under the disk 43 is fixed a packing 45 of plastic material, preferably of Delrin, the periphery of which comprises a groove **45*a*. At one point on its periphery, this groove is perforated, and the shank of a pin 46 driven into a hole in the disk 43 projects slightly into the bottom of this groove. The printed circuit board 24 extends below the wheel 33 and bears facing the groove 45 a terminal 47 likewise made up of a bent gold lamella, so as to form a tongue with an end bent into a V and fitted into the groove 45*a*. Once per revolution of the wheel 33, the terminal 47 will therefore be grounded at the moment when the pin 46 enters into contact with its free end. One also sees in FIG. 3 the idle gear 32, as well as the hour wheel 31. The two wheels 31 and 33** have the same diameter.

The functioning of this watch corresponds to what has been described in connection with the first embodiment: a quartz 48 fixed under the printed circuit board 24 controls a frequency divider, the output pulses of which control, at a stable frequency, of 1 Hz for example, the driving of the motor. The circuit 23 further comprises a counter and a decoder which control the cell 21 starting from the pulses which the counter receives at each revolution of the wheel 33 when the contact element 46 is connected to the terminal 47. The decoder is arranged so as to cause the figures from 1 to 31 to appear successively on the cell 21. The date jump being controlled by the contact 46/47, it will always be synchronized with the position of the hands and will take place each time at midnight.

The correction of the date is effected electronically when the stem 34 is in the position II. As a matter of fact, the closing of the contact 41/40 controls in the electronic circuit 23 the emission of pulses, for example at a frequency of 1 Hz, but only starting two seconds counted from the closing of the contact, and these pulses at a frequency of 1 Hz are transmitted to the decoder so that the figures of the days march past on the cell 21 at the frequency of 1 Hz. In the same way, if setting is effected by means of the crown 34, causing the hands to pass through the midnight position, automatically a pulse will be given to the date decoder which will cause the cell to advance by one unit.

The counting of the pulses supplied by the contact 46/47 will be arranged so that at the moment when the contact element 46 comes in contact with the blade 47, a first pulse is recorded, and the recording of other pulses is blocked during the whole time during which the contact element slides under the blade 47. The false pulses which might result from bouncing of the blade 47 on the contact element 46 are thus avoided. The details of the arrangement of the circuit which permits picking up only the first pulse recorded are known per se, and it is not necessary to describe them here.

The contact blade 47 rests against the wheel 33 not only while the pin 46 is facing its tip, but also during the whole duration of the rotation of this wheel. It indeed rests against the bottom of the groove 45*a* and acts as friction, which eliminates gear backlash. The blade 47 therefore serves to regularize not only the rotation of the wheel 33 which triggers the change of date at midnight precisely, but also the rotation of the other indicating wheels, in particular the hour wheel 31 and the center wheel 29.

As a variant, the hour wheel 31 could be formed like the wheel 33 and bear a pin travelling in the path of a contact blade such as the contact blade 47. In this case, the wheel 33 and the wheel 32 could be eliminated. It would suffice for the electronic circuit to be formed in such a way that the change of date is controlled only every other time under the effect of the pulses resulting from the closing of the contact 46/47. Of course, cne could also eliminate the intermediate gear 32 and keep the wheel 33 as depicted in FIG. 3, disposing it in such a way that its wheel would mesh directly with the hour wheel 31. In this case, the wheel 33 would rotate at the same speed as the wheel 31, and the circuit would have to be arranged so as to control the change of date only every other time.

Figure 4:
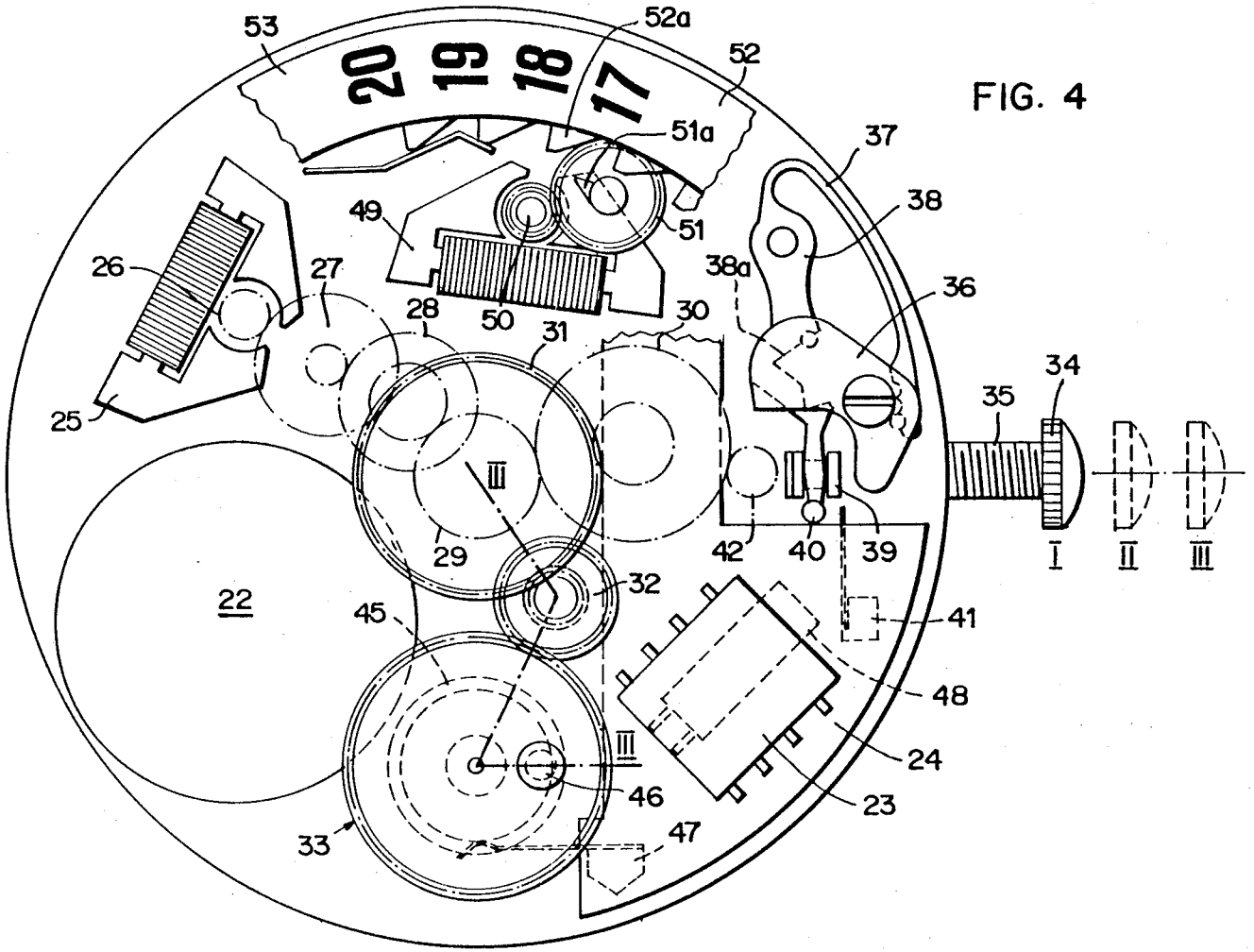

FIG. 4 represents an embodiment in which the means for displaying the date are different from those which are provided for in the embodiment according to FIG. 2, all the rest of the elements of the module being in other respects the same. These display means comprise a motor 49, the construction of which may be the same as that of the motor 25, but which, as will be seen presently, could function in a slightly different manner. The rotor 50 of this motor drives through its pinion a date-switching wheel-and-pinion 51, the finger 51*a* of which fits into the toothing 52*a* of a date ring 52, which may be of ordinary construction. This ring is disposed under the dial and bears on its upper surface the indications of the dates from 1 to 31. Its toothing likewise has 31 teeth, and it is held in place normally by means of a jumper spring 53. An aperture, which may be situated, for example, on three o'clock, or on noon, permits one of the dates borne by the ring 52 to be seen.

At each closing of the contact 46/47, the electronic circuit 23 controls the sending of a sequence of predetermined pulses to the motor 49. These pulses may follow one another at a relatively high frequency and cause the rotor 50 to rotate so that the wheel-and-pinion 51 effects one complete revolution about its own axis. In the course of this rotation, its finger 51*a* will fit into the toothing 52*a* and cause the date ring 52 to advance by one step. As this motor runs for only a very short time each day, the frequency of its running can be relatively high, and its driving torque can be weak since the driving is direct. Moreover, as the motor 25 is never loaded by the winding of a calendar mechanism, the resistance torque which it must overcome with each pulse to drive the wheel-train is very weak and, on the other hand, perfectly regular. Thus, the torque of this motor and the duration of its pulses can be adjusted to minimal values, which contributes to saving the power of the battery 22.

In this case also, the 24-hour wheel 33 is always synchronized with the hours and the minutes, even at the time of a correction of the time by the clutch-pinion 9 and the crown 34. It is therefore the 24-hour wheel which controls and guarantees the change of date and not an electronic circuit, the programming of which remains complex.

In addition, at the time of a change of battery, no information is lost.

For correcting the date, one proceeds as in the first embodiment. The stem 34 is pulled into position II, which closes the contact 40/41. The circuit 23 then controls the motor 49 continuously, so that the indications of the date march past in the aperture.

Of course, the motor 49 could also drive a calendar mechanism with date and days of the week comprising a day-star, just as, in the embodiment described with relation to FIG. 2, the cell 21 could also comprise a means for displaying the day of the week.

In the embodiment according to FIG. 2 as well as in that according to FIG. 4, it could then be provided for, to permit the desynchronization of the counting of the days relative to the counting of the dates, that when the stem is in position II, only the dates are corrected, whereas if the display is driven by means of the crown 34 in position III, the pulses caused by closing of the contact 46/47 control at the same time the jump of the date and the jump of the day of the week.

I claim:

1. A timepiece mechanism comprising:

a time standard;

a time display gear train controlled by said time standard and having at least one time displaying gear and a synchronizing rotary part, said synchronizing rotary part comprising a packing portion made of an insulating material and a metal grounding contact element secured to said packing portion;

date displaying means for displaying a date; and electronic control means for controlling said date displaying means, said electronic control means comprising an elastic contact blade biased into continuous contact with said synchronizing rotary part and alternately contacting said packing portion and said grounding element at predetermined times during rotation of said synchronizing rotary part, said control means detecting grounding of said contact blade when it contacts said grounding element and thereupon causing said date displaying means to advance the date displayed thereon by one unit.

2. The timepiece mechanism according to claim 1, wherein said gear train comprises a first part forming the rotor of a step motor and a last part forming said synchronizing rotary part, said synchronizing rotary part being the slowest part of the gear train and said elastic blade thus acting continuously as a friction brake for eliminating gear backlash.

3. The timepiece mechanism according to claim 1, wherein said synchronizing rotary part further comprises a metal disc having a toothed peripheral edge, said toothed edge being in meshing engagement with another part of said gear train, and an arbor bearing said toothed disc, wherein said packing portion comprises a packing disc of insulating material mounted on one face of said metal disc and having a peripheral side face, and wherein said grounding element comprises a pin protruding from said toothed disc and countersunk in said packing disc so as to be flush with a portion of said peripheral side face of said packing disc, said eleastic blade being radially biased against said peripheral side face.

4. A timepiece according to claim 3, wherein said peripheral side face of said packing disc further comprises the bottom face of a peripheral groove provided in said packing disc.

5. The timepiece according to claim 1, further comprising a manual setting mechanism, said manual setting mechanism comprising:

a rotatable stem axially movable to at least two positions;

a clutch pinion coupled to said stem for axial and rotational movement therewith and also coupled to a second grounding contact element, said second contact element being integral with a lever part for displacing said clutch pinion;

a second blade connected to said electronic control means and groundable by contact with said second contact element, said electronic control means causing said date display means repeatedly to advance the date displayed thereon upon detecting grounding of said second blade;

wherein said clutch pinion is moved into engagement with said gear train to allow manual setting thereof by rotation of said stem when said stem is moved to a first of said at least two positions and wherein said second contact element is moved into contact with said second blade when said stem is moved into a second of said at least two positions.

* * * * *